US006311853B1

(12) United States Patent
Johnson

(10) Patent No.: US 6,311,853 B1
(45) Date of Patent: Nov. 6, 2001

(54) TOOL RACK

(76) Inventor: Glenn Johnson, 25 Woodside Dr., Robbinsville, NJ (US) 08691

( * ) Notice: Subject to any disclaimer, the term of this patent is extended or adjusted under 35 U.S.C. 154(b) by 0 days.

(21) Appl. No.: 09/588,543

(22) Filed: Jun. 7, 2000

(51) Int. Cl.[7] ..... A47F 7/00

(52) U.S. Cl. ..... 211/70.6; 211/113; 248/309.1; 248/214; 224/405

(58) Field of Search ..... 211/70.6, 113, 211/13.1, 86.01; 248/309.1, 300, 317, 214; 224/405, 403

(56) References Cited

U.S. PATENT DOCUMENTS

D. 245,214 * 8/1977 Allen .
3,915,308 * 10/1975 Ratzloff et al. ..... 211/70.6 X
3,985,324 * 10/1976 Larson ..... 211/70.6 X
4,467,925 * 8/1984 Ratzloff et al. ..... 211/70.6
4,767,092 * 8/1988 Weatherly ..... 248/214 X
5,295,649 * 3/1994 Lee ..... 248/214 X
5,647,489 * 7/1997 Bellis ..... 211/70.6
5,823,360 * 10/1998 Gorosave ..... 211/13.1
5,871,192 * 2/1999 Horwitz ..... 248/309.1
6,053,339 * 4/2000 Bellis ..... 211/70.6
6,250,400 * 6/2001 Bucko .

* cited by examiner

*Primary Examiner*—Robert W Gibson, Jr.
(74) *Attorney, Agent, or Firm*—Daniel S. Kirshner

(57) ABSTRACT

A tool rack for securing and transporting lawn edgers formed from steel or other rigid material. The tool rack comprises a central spine, two edger retaining arms, a wheel retaining slot, and a trailer wall retaining means. The edger retaining arms are attached to the central spine and are bent inward toward each other twice. The wheel retaining slot is formed from two parallel pieces of metal and extend from the front surface of the central spine at the bottom thereof. The trailer wall retaining means is located at the top of the central spine and extends from the back thereof.

10 Claims, 3 Drawing Sheets

22
12
10
14
16
18
20

TOOL RACK

FIELD OF THE INVENTION

The present invention is a tool rack. More specifically, the present invention is a tool rack that is used to transport and secure a lawn edger in an enclosed landscape trailer.

BACKGROUND OF THE INVENTION

The present invention tool rack is used to secure and transport a lawn edger in an enclosed landscape trailer. Specifically, the present invention tool rack is designed to be most effective in securing and the Little Wonder® Xtra™ lawn edger which is depicted by the broken lines in FIG. 2. The Little Wonder® lawn edge is designed much like a wheelbarrow in that it has two long handles H and is pushed on its single wheel W located at its bottom. The long handles H are bent on 45° angles in towards each other and eventually meet where they attach to the engine E.

It would be a great advantage for a landscaper to be able to securely attach the lawn edger to the side wall of a landscaping trailer when transporting the edger from one job site to another, and such is the objective of the present invention.

Other objectives, advantages and novel features, and further scope of applicability of the present invention will be set forth in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The present invention is a tool rack designed to retain and secure lawn edgers to the wall of a landscaping trailer for the purpose of transporting the edger from one job site to another. The tool rack is formed from steel or other rigid material and has a central spine in the shape of an elongated shaft. Attached to the central spine are two edger retaining arms that extend outward from the central spine. The two edger retaining arms bend inward towards each other at an angle of approximately 45°. The last two inches of the edger retaining arms bend inward again and again at an angle of approximately 45°. A wheel retaining slot is disposed at the bottom of the central spine which is formed from two parallel pieces of metal. Finally, a trailer wall attachment means is located at the top of the central spine and extends downward from the back of the central spine at an angle of approximately 45°. An edger is secured into the present invention tool rack by placing the handles of the edger within the edger retaining arms and placing the wheel of the edger within the wheel retaining slot. Now, the entire assembly of edger and rack can be secured to the side wall of a landscaping trailer by hooking the trailer wall attachment means over the wall of the trailer.

BRIEF DESCRIPTION OF THE DRAWINGS

For a better understanding of the present invention, reference is made to the following description of an exemplary embodiment thereof, considered in conjunction with the accompanying drawing, in which.

DETAILED DESCRIPTION OF THE INVENTION

The present invention is a tool rack. More specifically, the present invention is a tool rack which is designed to secure a lawn edger to the side wall of a landscaping trailer for the purpose of transporting the edger from one job site to another. Even more specifically, although it can be utilized to transport other types of tools or lawn edgers, the present invention is designed to interact most effectively with the Little Wonder® Xtra™ lawn edger.

Figure 1:
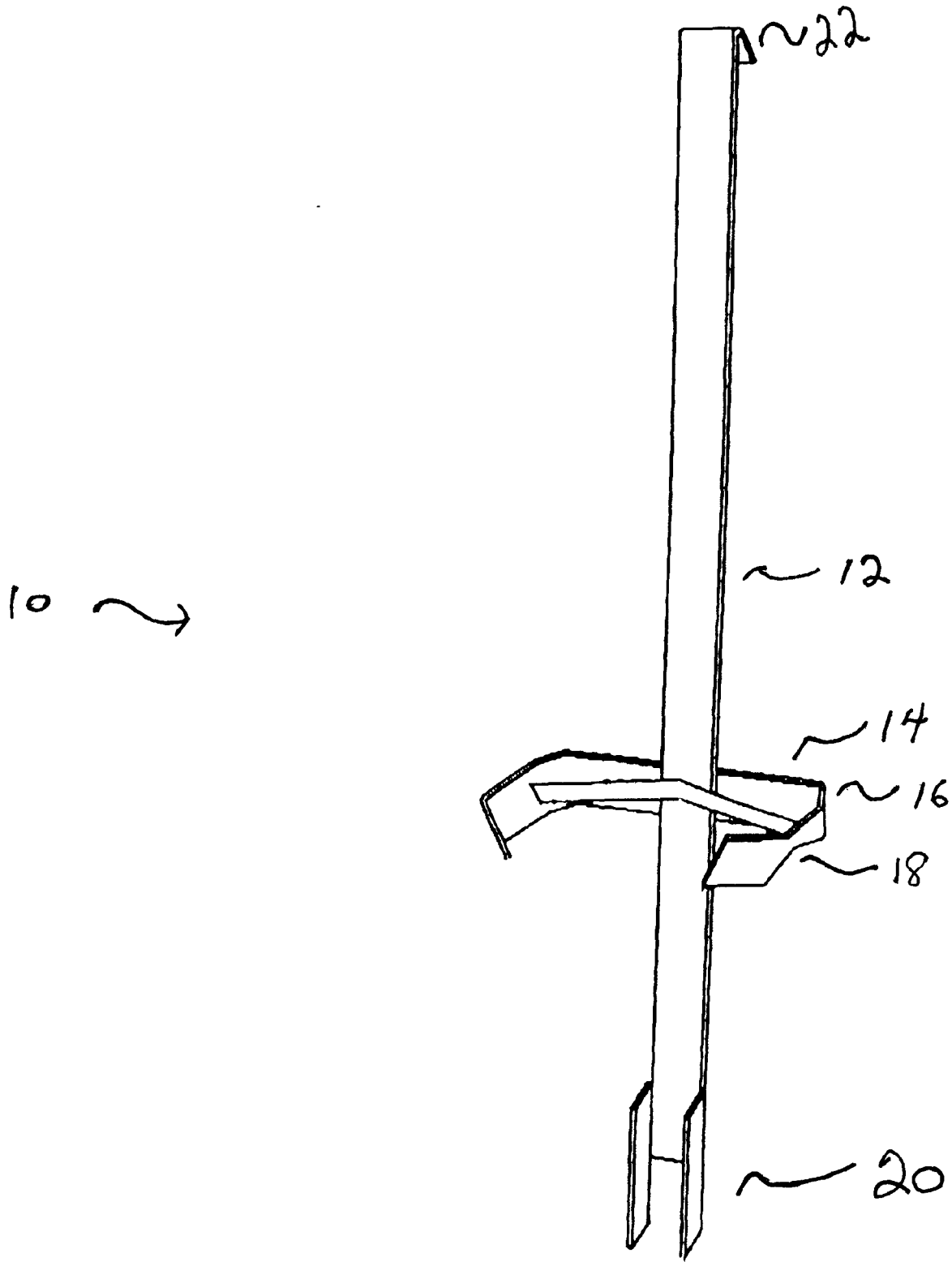
FIG. 1 is a front prospective view of the present invention tool rack.

Referring to FIG. 1, the present invention tool rack 10 is manufactured from a rigid material. As depicted in FIG. 1, the tool rack 10 is manufactured from steel, although any other rigid metal or other rigid material is suitable. The tool rack 10 has a central spine 12 in the form of an elongated flat shaft of metal. As can be seen in the Figures, the central spine 12 has a top and bottom edge, a front and back surface and two side edges. Attached to the central spine 12 are two edger retaining arms 14. The edger retaining arms 14 protrude out from the side edges of the central spine 12 in a direction that is generally perpendicular to the longitudinal axis of the central spine 12. The edger retaining arms 14 are sized and configured to secure the lawn edger. The edger retaining arms 14 are bent at an approximately 45° angle in towards each other from the front surface of the central spine at point 16. The last two inches of the edger retaining arms 14 are again bent at an approximately 45° angle in towards each other at point 18. To prevent damage to the lawn edger during transportation and to further secure the edger, the edger retaining arms 14 are rubber coated.

Still referring to FIG. 1, a wheel retaining slot 20 is provided at the bottom of the central spine 12. The wheel retaining slot 20 is formed from two parallel walls of metal or other rigid material which extend out from the sides of the central spine 12 and are generally perpendicular to the face of the central spine 12 and extend from the front surface therefrom. As such, a slot is formed between the two parallel walls where the slot is a depth appropriate to secure the wheel of the lawn edger. In the embodiment depicted in FIG. 1, the wheel retaining slot is about two inches in depth and about six inches in length.

Figure 3:
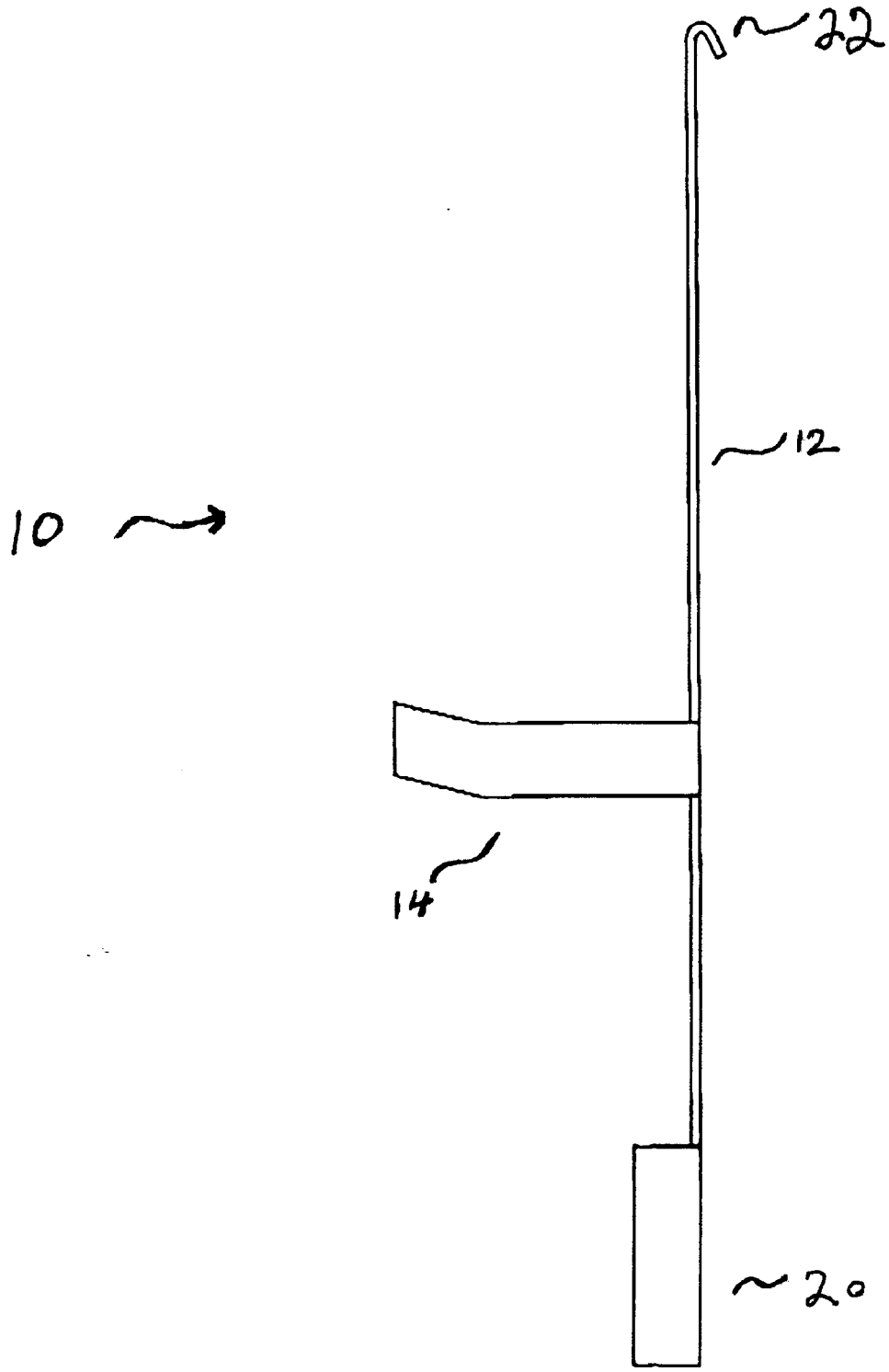
FIG. 3 is a side prospective view of the present invention tool rack.

Referring now to FIG. 3, at the top of the central spine 12 of the tool rack 10, extends a trailer wall attachment means 22. The trailer wall attachment means 22 formed from metal or other rigid material and extends from the back surface of the central spine 12. The trailer wall attachment means 22 extends downward at approximately a 45° angle and has a length of approximately two inches.

Figure 2:
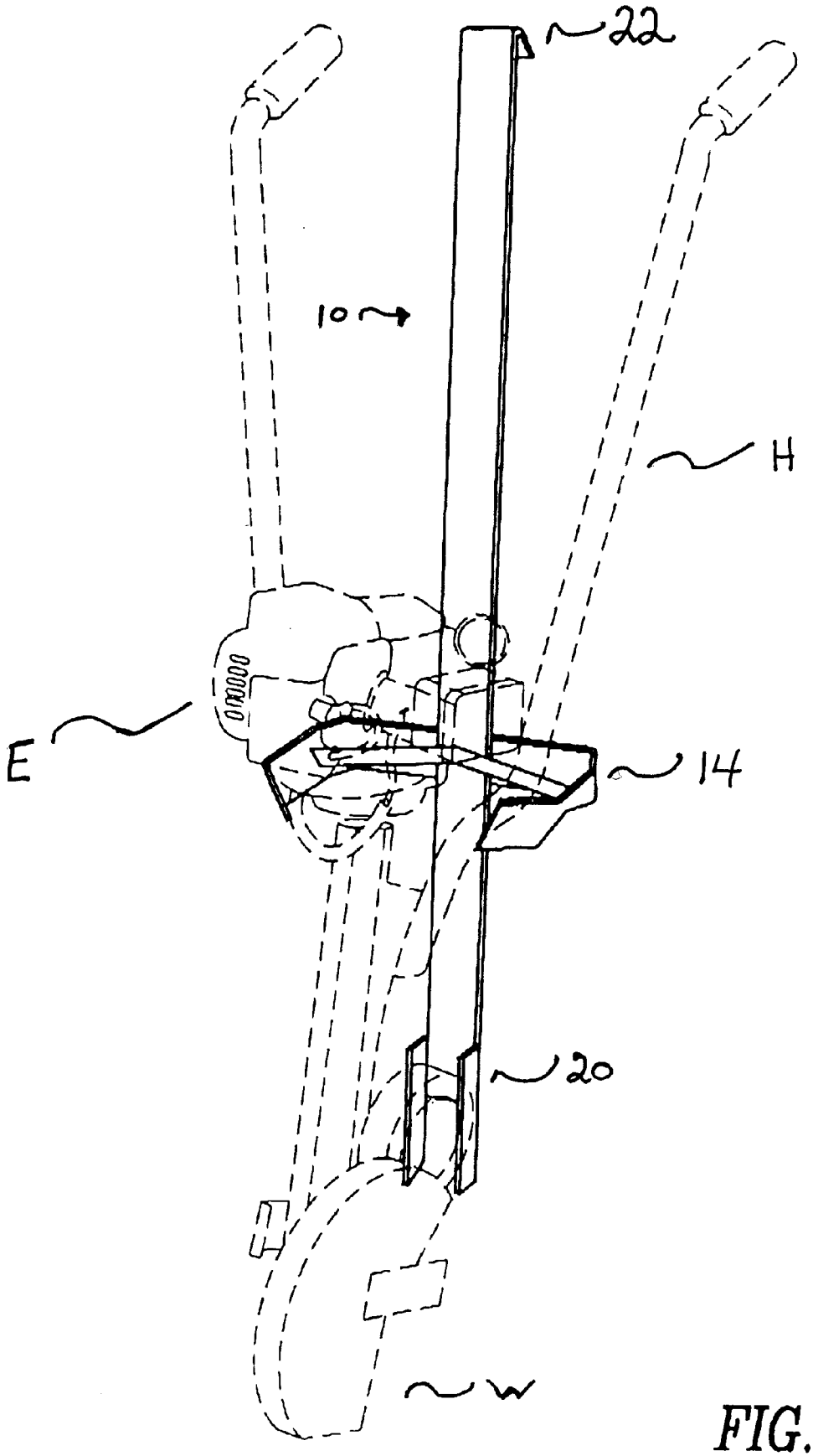
FIG. 2 is a front prospective view of the present invention tool rack in which the prior art edger is depicted by broken lines.

Now, the application of the tool rack 10 is evident by reference to FIG. 2 which depicts the Little Wonder® edger secured into position by the present invention tool rack 10. The handles H of the edger are secured by the edger retainer arms 14 of the tool rack 10. The wheel W of the edger is secured by the wheel retaining slot 20 of the present invention tool rack 10. Finally, the entire assembly of the edger and tool rack 10 are secured to the wall of the enclosed trailer by hooking the trailer wall attachment means 22 over the wall of the trailer.

It should be evident that the tool rack 10 of the present invention can also be used on open (as opposed to enclosed)

landscape trailers. Finally, it is evident that the tool rack 10 can be utilized for freestanding store displays or wall displays.

What is claimed is:

1. A tool rack comprising:

an elongated central spine, said central spine having top and bottom edges, front and back surfaces, and side edges, two edger retainer arms attached to said central spine, a wheel retaining slot attached to said central spine and extending from said front surface at the bottom edge therefrom, and, a trailer wall attachment means attached to said central spine and extending from said back surface at the top edge therefrom.

2. The tool rack of claim 1 wherein said edger retaining arms protrude from said central spine in a direction that is generally perpendicular to a longitudinal axis of said central spine.

3. The tool rack of claim 2 wherein said edger retaining arms are bent at a predetermined angle toward each other and from the front surface of said central spine.

4. The tool rack of claim 3 wherein said predetermined angle is approximately 45°.

5. The tool rack of claim 3 wherein said edger retaining arms are bent inward a second time at a predetermined angle.

6. The tool rack of claim 5 wherein said predetermined angle is approximately 45°.

7. The tool rack of claim 1 wherein said wheel retain slot comprises two parallel walls, said parallel walls extending from the side edges and from the front surface of said central spine at the bottom thereof and generally perpendicular thereto.

8. The tool rack of claim 1 wherein said trailer wall attachment means extends from the back surface of said central spine at the top thereof.

9. The tool rack of claim 8 wherein said trailer wall attachment means extends downward from said back surface of said central spine at a predetermined angle.

10. The tool rack of claim 9 wherein said predetermined angle is approximately 45°.

* * * * *